United States Patent [19]

Focke

[11] Patent Number: 4,646,938

[45] Date of Patent: Mar. 3, 1987

[54] APPARATUS FOR PACKAGING ELONGATE ARTICLES, ESPECIALLY CIGARETTES

[75] Inventor: Heinz Focke, Verden, Fed. Rep. of Germany

[73] Assignee: Focke & Co. (GmbH & Co.), Fed. Rep. of Germany

[21] Appl. No.: 661,754

[22] Filed: Oct. 17, 1984

[30] Foreign Application Priority Data

Nov. 3, 1983 [DE] Fed. Rep. of Germany ..... 3339703

[51] Int. Cl.[4] ..... B23Q 7/12; B65G 59/00; B65B 19/04

[52] U.S. Cl. ..... 221/175; 221/224; 221/268; 221/251; 53/150; 53/151

[58] Field of Search ..... 221/175, 224, 251, 268; 53/150, 151, 148, 149, 236; 198/420

[56] References Cited

U.S. PATENT DOCUMENTS

| | | | |
|---|---|---|---|
| 1,688,982 | 10/1928 | Molins | 53/151 X |
| 1,765,820 | 6/1930 | Bronander et al. | 53/149 X |
| 2,241,072 | 5/1941 | Raschke et al. | 53/151 |
| 2,682,983 | 7/1954 | Aschcroft | 53/151 |
| 2,770,392 | 11/1956 | Roberts | 221/251 X |
| 3,435,940 | 4/1969 | Searagnoli | 53/151 X |
| 3,501,052 | 3/1970 | Rudszinat | 221/175 |

FOREIGN PATENT DOCUMENTS

| | | | |
|---|---|---|---|
| 2320396 | 10/1974 | Fed. Rep. of Germany | 53/148 |

*Primary Examiner*—Joseph J. Rolla
*Assistant Examiner*—Gregory L. Huson
*Attorney, Agent, or Firm*—Sughrue, Mion, Zinn, Macpeak, and Seas

[57] ABSTRACT

Cigarette magazine consisting of several shafts (12), in each of which cigarettes are supported in rows on top of one another so as to be pushed out in groups from a rest at the lower end of the shafts (12). To prevent the following cigarettes from becoming jammed after a group of cigarettes has been pushed out, there is a supporting bar on which the cigarettes are temporarily supported during their downward movement. The supporting bar is subsequently lowered from its supporting position, so that the following cigarettes finally sit properly aligned on the lower rest prior to the pushing out of another group.

11 Claims, 4 Drawing Figures

44
42
47
46
41
48
45
43
36
14
34
40
39
13
38
37
21
24
28
29
31
25
23
27
30
49
22
14
17(18)
19
20

APPARATUS FOR PACKAGING ELONGATE ARTICLES, ESPECIALLY CIGARETTES

The invention relates to an apparatus for packaging elongate articles, especially cigarettes, which are supported in essentially vertical rows in shafts of a container (magazine) on a lower rest or the like, apparatus groups of cigarettes or the like in the lower region of the shafts can be pushed out by finger-like rams of a slide moveable to and fro, each of these rams penetrating into a shaft, and apparatus the cigarettes remaining in the shafts after the pushing-out action can be lowered down to the lower resting position by means of a movable supporting device.

In the packaging of cigarettes, it is customary to introduce them into a container (magazine) assigned to the packaging machine. A magazine of this type consists of an upper, partially funnel-shaped collecting container and lower shafts connected to the latter. The dimensions of the essentially vertical shafts are such that each of them accommodates a row of individual cigarettes lying on top of one another. The shafts are separated from one another by shaft walls. In the region of an upper inlet orifice to the shafts, there are within the magazine moving members which guarantee an orderly entry of cigarettes into the shafts.

In the region of the lower end of the shafts, the cigarettes are extracted in groups. For this purpose, there is a slide which is movable to and fro, and which penetrates by means of individual fingers into the lower region of each shaft and pushes several cigarettes, usually three, lying on top of one another out of the shaft in the longitudinal direction of the cigarettes. A cigarette group assigned to a pack is obtained as a result.

A problem which arises as regards the design and operation of a magazine of this type is that the cigarettes, resting on top of one another and remaining in the shafts after a cigarette group has been pushed out, fall down onto the lower rest as a result of their own weight. If the differences in height are relatively great (three cigarettes pushed out from each shaft), disadvantages can arise, in particular jamming, slanting, etc., of the cigarettes.

German Auslegeschrift 2,638,476 describes a cigarette magazine in which, to avoid the difficulties mentioned above, supporting devices in the form of narrow webs penetrate into the shafts from below, in order to support the cigarettes falling down and lower them in an orderly fashion onto the lower rest. A plate-shaped rest is provided for this purpose with through-slots through which the supporting webs penetrate. As a result of this, after the supporting webs have returned to the initial position, the cigarettes within the shafts rest on extremely thin supporting walls. Damage to the cigarettes can consequently occur, especially when they are pushed out of the shafts.

The object of the invention is to develop further and improve a (cigarette) magazine in such a way that an orderly passage of the cigarettes is guaranteed from their entry into the shafts until they are pushed out of the shafts, and in such a way that the following cigarettes are faultlessly lowered onto the lower rest as the slide returns to the initial position. At the same time, the lower cigarettes will sit on a rest which has as large a surface as possible.

To achieve this object, the apparatus according to the invention has at least one common supporting member which can be introduced at a distance from the lower rest into the region of the shafts after the partial retraction of the rams and which is intended for the intermediate support of the cigarettes, the supporting member likewise being moveable out of the supporting position after the complete retraction of the rams.

Consequently, in the magazine designed according to the invention, the following cigarettes are lowered in steps until they reach the lower rest, preferably with alternate slanting of the cigarettes, the cigarette being first supported at one end at a lower level and then at the other end at a level even lower than that. The ends of the retracting rams at the same time form a first support for the ends of the cigarettes facing the rams, the opposite ends of the cigarettes resting (temporarily) on a supporting bar extending at a shorter distance from the lower recess. As soon as the rams are completely retracted from the shafts, the ends of the cigarettes facing the rams are lowered further, below the height predetermined by the supporting bar, and onto the rest. The supporting bar is subsequently moved out of its supporting position, so that the cigarettes reach the lower end position completely.

During this action of lowering the cigarettes in steps, with an alternating movement of one end and the other, mechanical stresses on the cigarettes, but also tilting, slanting, etc., are avoided. The cigarettes in the shafts undergo a loosening influence.

According to a further proposal of the invention, the orderly flow of cigarettes within the shafts is monitored by tracer lugs which are assigned to each shaft and which penetrate into the shaft as a result of their own weight when there is an interruption in the stream of cigarettes. So that these tracer lugs can be moved out of the shaft again by the cigarettes after the interruption has been rectified, the relative position of the tracer lugs when they penetrate into the shaft is limited by a stop, in such a way that it is directly possible for the tracer lug to be swung back by the cigarettes. According to the invention, the stop consists of a transversely directed stop bar which passes through a (circular) orifice in the tracer lugs.

Furthermore, special jolting members are arranged in the region of the inlet side of the shafts, specifically on the upper ends of the shaft walls. The jolting bars driven to rotate to and fro are reduced, in particular tapered, on at least one end. This prevents the cigarettes from being subjected to mechanical stress at their ends by the rotating jolting bars and prevents tobacco from escaping from the open end faces as a result. Where non-filter cigarettes are concerned, both ends of the jolting bars are tapered.

Further features of the invention relate to the design and arrangement of the supporting device in the lower region of the shafts and to the mounting and design of the tracer lugs and the jolting bars.

An exemplary embodiment of the invention is explained in more detail below with reference to the drawings in which.

Figure 1:
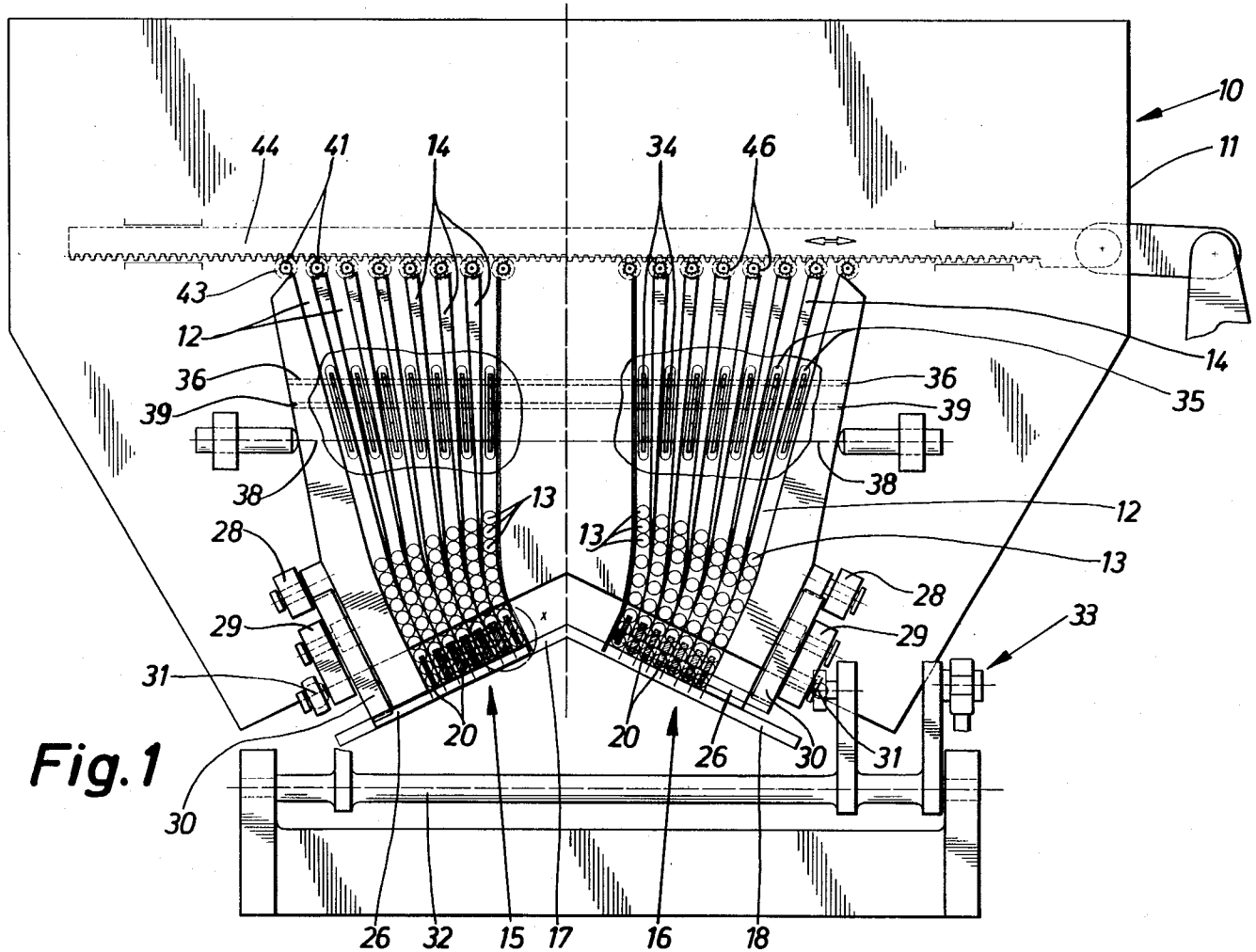
FIG. 1 shows a magazine for cigarettes in a front view.

A cigarette magazine 10 of the present design is assigned to a packaging machine for cigarettes which is not shown in detail. The cigarettes, coming from a production machine (not shown), are introduced from above into a funnel-shaped container 11 of the cigarette magazine 10. A number of shafts 12 is formed in this container, in particular vertical elongate channels, in each of which individual cigarettes 13 lying in a row on top of one another are accommodated. The cigarettes are normally arranged close to one another in a shaft 12 of this type. These shafts are separated from one another by shaft walls 14. In the present exemplary embodiment, the shaft walls have a cross-section converging in a downward direction and accordingly taper to a point. Furthermore, the shaft walls 14 are arcuate in the lower region, so that the shafts 12 defined by the walls also have an arcuate form in the lower region.

Two groups 15 and 16 of shafts 12 are formed in the present cigarette magazine. Each serves to form a cigarette group corresponding to the number of cigarettes to be received in a cigarette pack.

The lower cigarettes 13 in each shaft 12 are supported on a rest which is inclined in the present case and which takes the form of a supporting plate 17 or 18. These plates are arranged transversely (perpendicularly) to the (inclined) shaft walls 14 and are therefore themselves inclined at an angle to one another.

The cigarettes 13 pass into one of the shafts 12 essentially under their own weight and form in the latter a continuous row of cigarettes 13 arranged above one another. At the lower end of the shafts 12, a number of the lower cigarettes 13 resting on the supporting plates 17 and 18 is conveyed away from each of the groups 15 and 16 of the shafts 12, specifically a cigarette group corresponding to the contents of a cigarette pack. In the present exemplary embodiment, a cigarette group consisting of the lower three cigarettes 13 of a particular shaft 12 is ejected from the latter and conveyed away.

Figure 2:
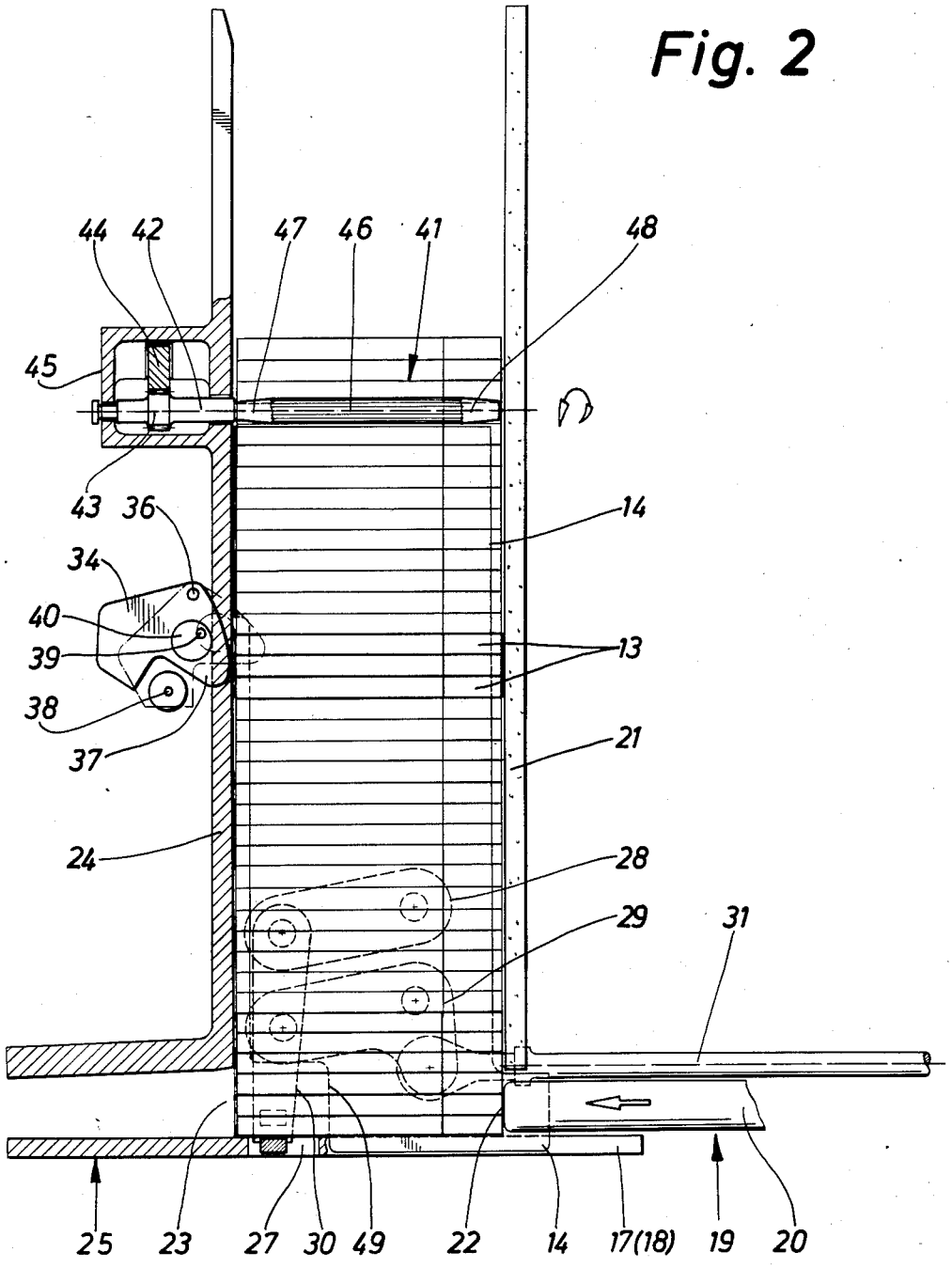
FIG. 2 shows the magazine according to FIG. 1 in a vertical section through a shaft, on a enlarged scale.

To push out an appropriate number of cigarettes 13 from each shaft 12, there is a slide 19 which has a number of finger-like or web-like rams 20 corresponding to the number of shafts 12 to be emptied. Each of these rams 20, of rectangular cross-section and designed as a flat profile, penetrates into a shaft 12 from the rear side (on the right in FIG. 2) and pushes out on the opposite side a number of cigarettes 13 arranged on top of one another and corresponding to the rams height. A vertical rear wall 21 limiting the magazine on the rear side is provided with an appropriate entry recess in the region of the to-and-fro movements of the slide 19 or rams 20. An outlet orifice 23 in the region of an opposite front wall 24 leads into a horizontal cigarette shaft 25 which is adjacent to the supporting plate 17 or 18 and to the front wall 24 and through which the cigarette group now formed is fed to a further conveyor.

Figure 3:
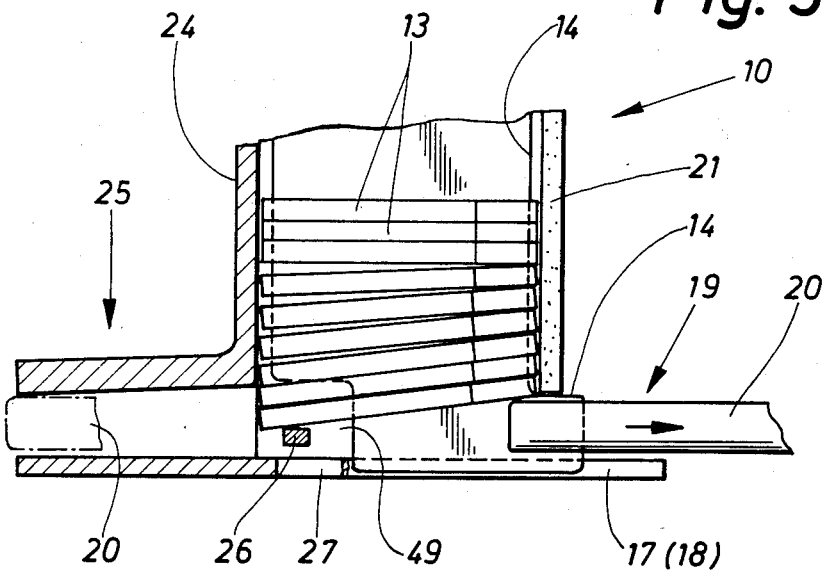
FIG. 3 shows the lower region of a shaft in a vertical section.
Figure 4:
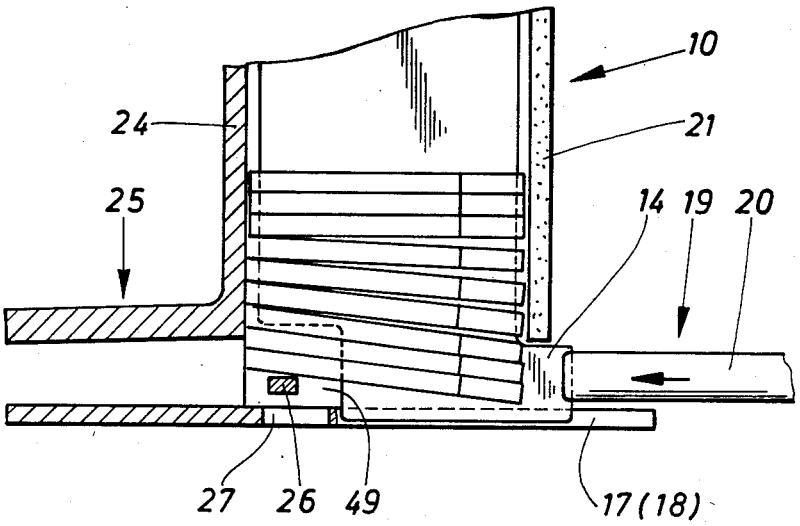
FIG. 4 shows a representation corresponding to FIG. 3 with a changed relative position of the cigarettes and individual members.

After a cigarette group has been pushed out of the shafts 12, the slide 19 and its rams 20 are moved back into an initial position, in which the rams 20 are completely retracted from the shafts 12 (FIG. 4). The further cigarettes located above the pushed-out cigarettes can now fall down in the shafts 12 as a result of their own weight. At the same time, with the cigarettes temporarily being slanted during the return movement of the rams 20, it is necessary to overcome a height of fall which corresponds to that of the (three) pushed-out cigarettes or to the constructional height of the rams 20. In order, during this downward movement, to avoid undesirable slanting and consequent jamming of the cigarettes 13, a moveable supporting device in the form of a supporting bar 26 is arranged adjacent to the outlet orifice 23, that is to say on the side located opposite the ends of the rams 20 retracted from the shafts 12. In the present exemplary embodiment, this supporting bar can move up and down, that is from a lower retracted position according to FIG. 2 into the upper supporting position according to FIGS. 3 and 4. In the latter position, the supporting bar 26 is located approximately at half the height of the falling distance of the cigarettes.

During the rearward movement of the rams 20, the supporting bar 26 is moved into the abovementioned supporting position according to FIGS. 3 and 4. The ends of the cigarettes 13 remote from the returning ram 20 can consequently come to rest on the supporting bar 26, after a pivoting movement extending over approximately half the height of the total falling distance has been executed by the cigarettes (FIG. 3). During this phase, the opposite end regions of the cigarettes 13 are still supported on the ram 20 which is in the course of a rearward movement. As soon as the ram leaves the shaft 12, the ends of the cigarettes 13 facing this side (rear wall 21) are moved under their own weight until they come to rest on the supporting plate 17 or 18, at the same time executing a pivoting movement because the opposite ends are supported on the supporting bar 26 (FIG. 4). When the cigarettes have reached this position, the supporting bar 26 is lowered into the lower initial position according to FIG. 2. At the same time, the portions of the cigarettes resting on the supporting bar are likewise moved downwards until they rest completely on the supporting plates 17, 18. The cigarettes have now reached a proper lower end position and can be ejected in groups in the way previously described.

The supporting plates 17, 18 are provided, on the side facing the outlet orifice 23, with a continuous elongate orifice 27 into which the supporting bar 26 is lowered in the lower position. For permitting the movements of the supporting bar 26, the shaft walls 14 are provided in their lower region with a recess 49 facing the outlet orifice 23.

In the present exemplary embodiment, a separate supporting bar 26 is assigned to each group 15, 16 of shafts 12. The two supporting bars are driven in the way described via means including a parallelogram linkage having parallel links 28 and 29 and a supporting bracket 30 moveable up and down by the link. A connecting rod 31 is connected to the parallelogram linkage (parallel link 29) and is driven to and fro by a central drive shaft 32. The drive shaft 32 is itself moved by a crank mechanism 33.

A further device for guaranteeing the proper downward movement of the cigarettes 13 in the shafts 12 consists of tracer lugs 34 assigned to each shaft 12. These are thin-walled pieces of flat material which project into the shafts 12 via slots 35 in the front wall 24. The tracer lugs 34 are mounted pivotably outside the shafts on a common transversely directed retaining rod 36. The tracer lugs 34 are designed or arranged off-center in relation to the retaining rod 36, in such a way that when cigarettes are absent in one of the shafts 12, the respective tracer lug is pivoted under its own weight, in such a way that a nose 37 of the tracer lug 34 penetrates into the particular shaft 12 (the dot-and-dash line in FIG. 2). This produces a change in the relative position of the respective tracer lug 34 in relation to a transversely directed light beam 38 which, when interrupted causes a fault signal to be triggered.

So that the tracer lug 34 or the nose 37 does not penetrate too far (too deep) into the shaft 12, the amount of movement of the tracer lug 34 is limited, specifically by a transversely directed stop bar 39 common to all the tracer lugs. This passes through a (circular) hole 40 in the tracer lugs. The edge of the hole 40 comes up against the stop bar 39 as soon as the tracer lug penetrates into the particular shaft 12 because of the absence of cigarettes. As soon as the fault has been rectified and the particular shaft provided with an uninterrupted sequence of cigarettes, the tracer lug is automatically swung back into the initial position (the unbroken line in FIG. 2) as a result of the cigarettes subsequently conveyed. In this fault-free position, the nose 37 rests against the front ends of the cigarettes facing it in the shaft.

A further device for the proper transport of the cigarettes in the shafts 12 relates to the entry of the cigarettes into these the shafts. As is evident from FIG. 1, the shaft walls 14 are made wedge-shaped, widening upwards. Distributor members driven to rotate to and fro and taking the form of elongate, approximately cylindrical jolting bars 41 are attached to the upper ends of the shaft walls 14 designed in this way. These jolting bars are guided at one end through the front wall 24 of the magazine by means of an extension 42 and are mounted rotatably outside the magazine. A pinion 43 is formed on each of the extensions 42, and these pinions mesh with a rack 44 common to all the jolting bars 41. As a result of the to-and-fro movement of the rack 44, the jolting bars 41 are made to rotate in alternating directions. The above-described transmission is accommodated in an elongate transmission housing 45 on the outside of the front wall 24.

The jolting bars 41 within the magazine, particularly at the infeed end of the shafts 12, are designed in a special way. Elevations and depressions extending in a longitudinal direction and taking the form of grooves 46 are located on the outer periphery. In the present jolting bars 41, these are formed in a middle region only. Cross-sectional reductions 47 and 48 are formed at the ends of the jolting bars, at both ends in the present exemplary embodiment. These conically tapering end of the jolting bars 41 ensure that the end regions of the cigarettes 13 are not subjected to mechanical stress by the jolting bars, and, consequently, no fine tobacco particles are pressed out of the cigarettes. The result of the design of the jolting bars 41 in the way described above is, therefore, that tobacco is prevented from escaping at the ends of the cigarettes as a result of the jolting movements. When filter cigarettes are processed, it is sufficient if a cross-sectional reduction is formed at one end only, namely at the end remote from the cigarette filter.

The individual devices for guaranteeing a faultless flow of cigarettes within the shafts 12, that is to say the supporting bar 26, the tracer lugs 34 and the jolting bars 41, can also be used independently of one another.

I claim:

1. An apparatus for packaging elongate articles, especially cigarettes, which are supported in essentially vertical rows in a plurality of shafts of a magazine on a lower rest, in which apparatus groups of cigarettes or the like in the lower region of the shafts can be pushed out by finger-like rams of a reciprocating slide, each of these rams penetrating into a repective shaft, and in which apparatus the cigarettes remaining in the shafts after the pushing-out action and retraction of the rams, can be lowered down to the lower rest by means of a moveable supporting device, said apparatus being characterized in that it has at least one supporting member (26) which can be moved to a supporting position above the lower rest (17, 18) inside the shafts (12) after partial retraction of the rams (20) and which provides intermediate support of the cigarettes (13), and moving means for moving the supporting member both into said supporting position and also out of the supporting position into a lowered position after the complete retraction of the rams (20);

wherein the supporting member consists of at least one supporting bar (26) extending transversely to the cigarettes (13); and wherein the supporting bar (26) is arranged off-center in relation to the longitudinal dimension of the cigarettes (13) toward the side of the shaft located opposite the slide (19), in such a way that the cigarettes first rest on the supporting bar (26) on their front ends remote from said slide and then, after the complete retraction of the rams (20) from the shafts (12), the rear ends of the cigarettes near said slide are lowered, by pivoting about said supporting bar, onto said lower rest (17, 18), and in such a way that the supporting bar (26) can subsequently be lowered into said lowered position so that the cigarettes are entirely supported only by said lower rest.

2. An apparatus as claimed in claim 1, wherein there is an orifice (27) in the lower rest (17, 18) for receiving said supporting bar when it is out of said supporting position.

3. An apparatus as claimed in claim 1, wherein each shaft has a wall (14) containing a recess (49) in which the supporting bar (26) can be moved up and down.

4. An apparatus as claimed in claim 1, wherein the shafts (12) are arranged in groups (15, 16) and wherein a common supporting bar (26) is assigned to the shafts of each group (15, 16), and wherein said moving means comprises parallelogram linkages which are attached to the sides of the cigarette magazine (10) and which include parallel links (28, 29) and a supporting bracket (30).

5. An apparatus as claimed in claim 1, wherein there is a pivotable tracer lug and a stop mounted adjacent each shaft, and wherein, when cigarettes (13) are absent in a shaft (12), a pivotable tracer lug (34) projects into the shaft (12) by pivoting under its own weight until it hits said stop (stop bar 39) in a stop position, and wherein the tracer lug (34) has a nose (37) which projects slightly into the respective shaft (12) in the stop position.

6. An apparatus as claimed in claim 5, wherein said stop comprises a stop bar (39) common to all the tracer lugs (34) and directed transversely relative to the tracer lugs (34).

7. An apparatus as claimed in claim 6, wherein the stop bar (39) passes through a hole (40) in the tracer lugs (34), and, in the pivoted position of a tracer lug (34), one edge of the hole (40) rests against the stop bar (39).

8. An apparatus as claimed in claim 1, wherein there are arranged at the upper ends of the shafts (12) distributor members which are directed parallel to the cigarettes and each of which is in the form of an elongate rotatable jolting bar (41) having opposite ends at least one of which is reduced in cross-sectional size (47, 48).

9. An apparatus as claimed in claim 8, wherein each jolting bar (41) is provided, on the outside thereof in a middle, cylindrical region only, with elevations and depressions in the form of longitudinally directed grooves (46).

10. An apparatus as claimed in claim 8 or 9, wherein the reduced one end of each of the jolting bars (41) is provided with an extension (42) on which is arranged a pinion (43) meshing with a reciprocating rack (44).

11. An apparatus as claimed in claim 10, wherein the extentions (42) of the jolting bars, the pinion (43) and the rack (44) are arranged in a transmission housing (45) on a front wall (24) of the cigarette magazine (10).

* * * * *